United States Patent [19]

Johnston et al.

[11] Patent Number: 4,804,389

[45] Date of Patent: Feb. 14, 1989

[54] FUEL PRODUCTS

[75] Inventors: Thomas E. Johnston, Mentor; Dorer, Jr. Casper J., Lyndhurst, both of Ohio

[73] Assignee: The Lubrizol Corporation, Wickliffe, Ohio

[21] Appl. No.: 95,484

[22] Filed: Dec. 1, 1987

Related U.S. Application Data

[63] Continuation of Ser. No. 903,936, Sep. 4, 1986, abandoned, and a continuation-in-part of Ser. No. 766,615, Aug. 16, 1985, Pat. No. 4,659,338.

[51] Int. Cl.[4] ..... C10L 1/18; C10L 1/22

[52] U.S. Cl. ..... 44/70; 44/71

[58] Field of Search ..... 44/70, 63, 62, 71

[56] References Cited

U.S. PATENT DOCUMENTS

| | | |
|---|---|---|
| 2,764,548 | 9/1956 | King et al. . |
| 2,862,800 | 12/1958 | Cantrel et al. . |
| 3,172,892 | 3/1965 | Le Suer . |
| 3,219,666 | 11/1966 | Norman . |
| 3,271,310 | 9/1966 | Le Suer . |
| 3,272,746 | 11/1966 | Le Suer . |
| 3,281,428 | 10/1966 | Le Suer . |
| 3,347,645 | 10/1967 | Pietsch et al. . |
| 3,443,918 | 5/1969 | Kautsky et al. . |
| 3,444,170 | 5/1969 | Norman et al. . |
| 3,649,229 | 3/1972 | Otto . |
| 4,240,803 | 12/1980 | Andress . |

FOREIGN PATENT DOCUMENTS

| | | |
|---|---|---|
| 910759 | 6/1970 | Canada . |
| 1055700 | 5/1979 | Canada . |
| 1192539 | 8/1985 | Canada . |
| 0207560 | 1/1987 | European Pat. Off. . |
| 1179184 | 1/1970 | United Kingdom . |
| 2177418 | 1/1987 | United Kingdom . |

*Primary Examiner*—William R. Dixon, Jr.
*Assistant Examiner*—James M. Hunter, Jr.
*Attorney, Agent, or Firm*—Forrest L. Collins; Joseph P. Fischer; William C. Tritt

[57] ABSTRACT

A fuel composition for internal combustion engines, and more particularly, a fuel composition for internal combustion engines containing less than about 0.5 gram of lead per gallon of fuel is described. The fuel provides acceptable valve seat protection in engines designed to operate on leaded or unleaded fuels. Ordinarily, leaded fuels contain components to reduce deposits within the engine cylinders which unleaded fuels do not. As leaded fuels become unavailable, some refiners will add valve protecting components to the unleaded fuels to satisfy the leaded market. Such fuels will then potentially cause an increase in the octane requirement. This invention deals with polybasic carboxylate additives having valve seat protection properties which avoid or minimize the octane requirement increase.

21 Claims, No Drawings

FUEL PRODUCTS

CROSS REFERENCE TO RELATED APPLICATIONS

This application is a continuation of U.S. Ser. No. 903,936 filed Sept. 4, 1986, now abandoned, and is further a continuation-in-part of U.S. Ser. No. 766,615 filed Aug. 16, 1985, now U.S. Pat. No. 4,659,338 issued Apr. 21, 1987.

BACKGROUND OF THE INVENTION

This invention relates to fuel compositions for internal combustion engines and more particularly to fuel compositions which are characterized as being either unleaded or low lead.

With the removal of lead additives such as, for example, tetraethyl lead and tetramethyl lead, from gasoline in order to reduce air pollution, it was discovered that the lead within the fuel had several desirable properties. It was found, for example, that the lead not only acted as an anti-knock agent, but was also effective in contributing toward the prevention of valve seat recession. In the conventional internal combustion gasoline engines, the exhaust valves generally seat against their valve seats with a slight rotary motion. This rotary motion is imparted to the valve stem during its operation to shift the relative position of the valve and to prevent uneven wear on the valve tip. The rotary motion also causes the valve to sit in different positions on each operation. With the elimination of the lead additives from gasoline, it has been found that a drastic increase in wear of the valve seat occurs. For example, see "Unleaded Versus Leaded Fuel Results in Laboratory Engine Tests", E. J. Fuchs, The Lubrizol Corporation, presented at the Society of Automotive Engineers National West Coast meeting, Vancouver, British Columbia, Canada, Aug. 16–19, 1971 (32 pages).

Valve seat wear is a function of engine design, load and speed conditions, and valve operating temperature. Valve seat wear is most severe under high speed and high load conditions. The problem of valve seat wear is observed in tractors, automobiles operated at high velocity, inboard and outboard motors, etc., especially when the internal combustion engines were designed primarily for leaded fuels.

U.S. Pat. No. 2,764,548 to King et al, issued Sept. 25, 1956, describes motor oils and motor fuels containing various salts of dinonylnaphthalene sulfonic acid including the sodium, potassium, calcium, barium, ammonium and amine salts. The salts are reported to be effective rust inhibitors.

U.S. Pat. No. 3,271,310 to LeSuer issued Sept. 6, 1966, describes the preparation of metal salts of alkenyl succinic acid which are useful as emulsifying agents, detergents and rust inhibitors in hydrocarbon oils, and in lubricants.

U.S. Pat. No. 3,506,416 to Patinkin, issued Apr. 14, 1970, describes leaded gasolines containing gasoline soluble salts of a hydroxamic acid of the formula RC(O)NHOH where R is a hydrocarbon group containing up to 30 carbon atoms. The metal may be selected from the Group Ia, IIa, IIIa, Va, Ib, IIb, IIIb, IVb, Vb, VIb, VIIb, VIII and tin.

U.S. Pat. No. 3,182,019, issued to Wilks et al on May 4, 1965, describes lubricating and fuel oils including complexes containing an alkali or alkaline earth metal carbonate in colloidal form.

The use of sodium in lead-free gasoline compositions for inhibiting valve seat recession is suggested in U.S. Pat. No. 3,955,938 to Graham et al, issued on May 11, 1976. The sodium may be incorporated into the fuel in a number of different forms such as sodium derivatives or organic compounds which are soluble, or dispersed in the gasoline. For example, simple sodium salts of an organic acid such as sodium petroleum sulfonate can be utilized although the sodium preferentially is added in the form of a sodium salt of an inorganic acid such as sodium carbonate in a colloidal dispersion in oil. Other convenient forms for introducing sodium into the fuel which are described in U.S. Pat. No. 3,955,938 include various sodium salts of sulfonic acids, sodium salts of saturated and unsaturated carboxylic acids, sodium salts of phosphosulfurized hydrocarbons such as may be prepared by reacting $P_2S_5$ with petroleum fractions such as bright stock, and sodium salts of phenols and alkylphenols. Various optional additives described by the Graham patent include corrosion inhibitors, rust inhibitors, anti-knock compounds, anti-oxidants, solvent oils, anti-static agents, octane appreciators, e.g. t-butyl acetate, dyes, anti-icing agents, e.g. isopropanol, hexyleneglycol, ashless dispersants, detergents, and the like. The amount of sodium additive included in the fuel is an amount to provide from about 0.5 to 20, preferably 0.5 to 10 lbs. of sodium per 1000 barrels of gasoline (2.86g/1000 liters is 1 lb/1000 bbl).

It also has been suggested that gasoline compositions can be improved by including certain detergents and dispersants. U.S. Pat. No. 3,443,918 to Kautsky et al, issued May 13, 1969, describes the addition to gasoline of mono-, bis-, or tris-alkenyl succinimides of a bis- or tris-polymethylene polyamine. These additives are reported to minimize harmful deposit formation when the fuels are used in internal combustion engines.

U.S. Pat. Nos. 3,172,892 to LeSuer, issued Mar. 9, 1965; 3,219,666 to Norman, issued Nov. 23, 1966; 3,272,746 to LeSuer, issued Nov. 23, 1966; 3,281,428 also to LeSuer, issued Oct. 25, 1966; and 3,444,170 to Norman et al, issued May 13, 1969 are directed to polyalkenyl succinic type ashless additives, and the Norman '170 patent teaches the use of the additive disclosed therein as a fuel detergent. U.S. Pat. No. 3,347,645 to Pietsch et al, issued Oct. 17, 1967 also describes the use of alkenyl succinimides as dispersants in gasoline, but it is there noted that the dispersants promote aqueous emulsion formation during storage and shipping. U.S. Pat. No. 3,649,229 to Otto, issued Mar. 14, 1972, teaches a fuel containing a detergent amount of a Mannich base prepared using, among other reactants, an alkenyl succinic compound. U.S. Pat. No. 4,240,803 issued to Andress on Dec. 23, 1980 also relates to hydrocarbon fuel compositions containing a detergent amount of a specific alkenyl succinimide wherein the alkenyl group is derived from a mixture of C16-28 olefins.

Although sodium salts of organic acids have been suggested as being useful additives in gasoline, and in particular, low lead or unleaded gasolines, such sodium salts have a tendency to emulsify water into gasoline, and with some sodium salts an undesirable extraction of the sodium into the water occurs.

The use of some alkali metal or alkaline earth metal salts results in some circumstances in deposits being formed which insulate the combustion cylinder resulting in an octane requirement increase (ORI). Some deposits also raise the pressure upon compression by taking up headspace in the cylinder which results in an ORI. Glowing deposits may also cause preignition, thereby causing knock. It has been discovered through analysis that these deposits are of a carbonaceous - metal nature. It has now been found that such deposits may be lessened and the availability of the salt for valve seat protection effectively increased as described herein.

The compositions described herein are effective in minimizing valve seat recession without substantially causing an octane requirement increase. Thus, the need for lead in the fuel is reduced or eliminated while avoiding the need for ingredients to minimize the ORI.

Throughout the specification and claims, temperatures are Celsius, percentage and ratios are by weight and pressures are in KPa gauge unless otherwise indicated. Publications cited herein are incorporated by reference.

SUMMARY OF THE INVENTION

This invention describes a fuel composition comprising gasoline and at least one hydrocarbon-soluble or dispersible polybasic carboxylate salt of an alkali or alkaline earth metal and mixtures thereof.

This invention further describes a fuel composition comprising gasoline and a hydrocarbon-soluble or dispersible polybasic carboxylate salt containing a hydrocarbyl residue wherein the molecular weight of the anionic portion of the salt is from about 400 to about 2000.

A concentrate is obtained for use in a fuel comprising an alkali metal or alkaline earth metal polybasic carboxylate salt and a hydrocarbon-soluble ashless dispersant.

A further embodiment of the invention is a process of reducing valve seat recession in an engine without substantially increasing the octane requirement by introducing to the combustion chamber of the engine a product comprising:

(A) a polybasic carboxylate salt;

(B) a dispersant; and (C) gasoline the amount of the polybasic carboxylate salt being sufficient to reduce the valve seat recession.

When the unleaded or low lead-containing fuels of the present invention are utilized in internal combustion engines, there is a significant reduction in valve seat recession without undue rise in the octane requirement. Methods of reducing valve seat recession in internal combustion engines utilizing unleaded or low lead-containing fuels also are described.

DESCRIPTION OF THE INVENTION

The fuels which are contemplated for use in the fuel compositions of the present invention are normally liquid hydrocarbon fuels in the gasoline boiling range, including hydrocarbon base fuels. The term "petroleum distillate fuel" also is used to describe the fuels which can be utilized in the fuel compositions of the present invention and which have the above characteristic boiling points. The term, however, is not intended to be restricted to straight-run distillate fractions. The distillate fuel can be straight-run distillate fuel, catalytically or thermally cracked (including hydro cracked) distillate fuel, or a mixture of straight-run distillate fuel, naphthas and the like with cracked distillate stocks. Also, the base fuels used in the formation of the fuel compositions of the present invention can be treated in accordance with well-known commercial methods, such as acid or caustic treatment, hydrogenation solvent refining, clay treatment, etc.

Gasolines are supplied in a number of different grades depending on the type of service for which they are intended. The gasolines utilized in the present invention include those designed as motor and aviation gasolines. Motor gasolines include those defined by ASTM specification D-439-73 and are composed of a mixture of various types of hydrocarbons including aromatics, olefins, paraffins, isoparaffins, naphthenes and occasionally diolefins. Motor gasolines normally have a boiling range within the limits of about 20° C. to 230° C., while aviation gasolines have narrower boiling ranges, usually within the limits of about 37° C. to 165° C.

The Alkali or Alkaline Earth Metal Containing Composition

The fuel compositions of the present invention will contain a minor amount of (A) at least one hydrocarbon-soluble or dispersible alkali or alkaline earth metal-containing polybasic-carboxylate salt. The term polybasic indicates that there are two or more carboxyl groups on the corresponding free acid which are capable of being neutralized with the alkali metal or alkaline earth metal cation.

The choice of the metal does not appear to be particularly critical although alkali metals are preferred, with sodium or potassium being the preferred alkali metals. These salts can be slightly acidic, neutral or basic. The acidic salts contain slightly less than one equivalent of metal per carboxyl group while the neutral salts contain an amount of metal cation just sufficient to neutralize the acidic groups present in salt anion. The basic salts contain an excess of metal cation and include overbased, hyperbased or superbased salts. The number of equivalents of cation per equivalent of carboxyl is preferably from 0.9 to 1.2 to 1.

The polybasic carboxylic acids from which suitable neutral and basic alkali metal and alkaline earth metal salts for use in this invention can be made include aliphatic, cycloaliphatic, and aromatic mono and polybasic carboxylic acids such as the naphthenic acids, alkyl- or alkenyl-substituted cyclopentanoic acids, the corresponding cyclohexanoic acids and the corresponding aromatic acids. The aliphatic acids generally contain at least eight carbon atoms and preferably at least twelve carbon atoms. Usually they have no more than about 400 carbon atoms. Generally, if the aliphatic carbon chain is branched, the acids are more oil soluble for any given carbon atom content.

A preferred group of oil-soluble carboxylic acids useful in preparing the salts used in the present invention are the oil-soluble aromatic carboxylic acids. These acids are represented by the general formula:

$$(R^*)_a Ar^*(CXXH)_m \qquad \text{Formula I}$$

where R* is an aliphatic hydrocarbon-based group of at least four carbon atoms, and no more than about 400 aliphatic carbon atoms, a is an integer of from zero to four to preferably one to four, Ar* is a polyvalent aromatic hydrocarbon nucleus of up to about 14 carbon atoms, each X is independently a sulfur or oxygen atom, and m is an integer of from two to four with the proviso that R* and a are such that there is an average of at least 8 aliphatic carbon atoms provided by the R* groups for each acid molecule represented by Formula I. Examples of aromatic nuclei represented by the variable Ar* are the polyvalent aromatic radicals derived from benzene, naphthalene, anthracene, phenanthrene, indene, fluorene, biphenyl, and the like. Generally, the radical represented by Ar* will be a polyvalent nucleus derived from benzene or naphthalene such as phenylenes and naphthylene, e.g., methylphenylenes, ethoxyphenylenes, nitropheynlenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc. Specific aromatic polybasic acids include phthalic acid, isophthalic acid, terephthalic acid, mellitic acid and their respective hydrocarbyl derivatives.

Additional acids which may be employed include citric acid and succinic acid and their derivatives. While the thiocarboxylates may be employed herein, the preferred components are the carboxylate salts.

The R* groups are usually purely hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.) lower alkoxy, lower alkyl mercapto, oxo substituents (i.e., =O), thio groups (i.e.,=S), interrupting groups such as —NH—, —O——, —S—, and the like provided the essentially hydrocarbon character of the R* group is retained. The hydrocarbon character is retained for purposes of this invention so long as any non-carbon atoms present in the R* group do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 2-hexenyl, cyclohexyloctyl, 4-(p-chlorophenyl)-octyl, 2,3,5-trimethylheptyl, 2-ethyl-5-methyloctyl, and substituents derived from polymerized olefins such as polychloroprenes, polyethylenes, polypropylenes, polyisobutylenes, ethylene/-propylene polymers, chlorinated olefin polymers, oxidized ethylene-propylene copolymers, and the like. Likewise, the group Ar may contain non-hydrocarbon substituents, for example, such diverse substituents as lower alkoxy, lower alkyl mercapto, nitro, halo, alkyl or alkenyl groups of less than four carbon atoms, hydroxy, mercapto and the like.

A group of particularly useful carboxylic acids are those of the formula:

$$R^*_a Ar^* (CXXH)_m(XH)_p \qquad \text{Formula II}$$

where R*, X, Ar*, m and a are as defined in Formula I and p is an integer of 1 to 4, usually 1 or 2. Within this group, an especially preferred class of oil-soluble carboxylic acids are those of the formula:

$$(R^{**})Ph_a(COOH)_b(OH)_c \qquad \text{Formula III}$$

where R in Formula III is an aliphatic hydrocarbon group containing at least 4 to about 400 carbon atoms, Ph is a phenyl group, a is an integer of from 1 to 3, b is 2 or greater, c is zero, 1, or 2 and preferably 1 with the proviso that R and a are such that the acid molecules contain at least an average of about twelve aliphatic carbon atoms in the aliphatic hydrocarbon substituents per acid molecule. And within this latter group of oil-soluble carboxylic acids, the aliphatic-hydrocarbon substituted salicylic acids wherein each aliphatic hydrocarbon substituent contains an average of at least about sixteen carbon atoms per substituent and one to three substituents per molecule are particularly useful. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene polymers and the like and having average carbon contents of about 30 to 400 carbon atoms.

The carboxylic acids corresponding to Formulae III and IV above are well known or can be prepared according to procedures known in the art. Carboxylic acids of the type illustrated by the above formulae and processes for preparing their neutral and basic metal salts are well known and disclosed, for example, in such U.S. Pat. Nos. as 2,197,832; 2,197,835; 2,252,662; 2,252,664; 2,714,092; 3,410,798 and 3,595,791.

Another type of neutral and basic carboxylate salt used in this invention are those derived from alkenyl succinates of the general formula:

$$R^*CH(COOH)CH_2COOH \qquad \text{Formula IV}$$

wherein R* is as defined above in Formula I. Such salts and means for making them are set forth in U.S. Pat. Nos. 3,271,130, and 3,567,637.

A further species useful herein are the disuccinates of the formula $$R^*[CH(COOH)CH_2COOH]_2 \qquad \text{Formula V}$$

which may be obtained from Meinhardt, U.S. Pat. No. 4,234,435 issued Nov. 18, 1980.

Generally, the molecular weight of the polybasic carboxylates will be about 400 to 2,000, preferably about 500 to 1500 for the anionic portion of the molecule. Such molecular weights will correspond to about 28 to about 145 carbon atoms, preferably about 35 to about 110 carbon atoms in the hydrocarbyl portion of the anion.

Other patehts specifically describing techniques for making basic salts of the hereinabove-described carboxylic acids include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,368,396; 3,342,733; 3,320,162; 3,312,618; 3,318,809; 3,471,403; 3,488,284; 3,595,790 and 3,629,109.

Mixtures of two or more acid, neutral and basic salts of the hereinabove described carboxylic acids can be used in the compositions of this invention. Usually the neutral and basic salts will be sodium, lithium, magnesium, calcium, or barium salts including mixtures of two or more of any of these. It is preferred that the overall balance of the salts be basic or at least neutral.

As mentioned above, the amount of alkali or alkaline earth metal containing composition (A) included in the fuel composition will be an amount which is sufficient to provide from about 1 to about 100 parts per million of the alkali metal or alkaline earth metal in the fuel composition. When utilized in lead free or low lead fuels, the amount of alkali metal or alkaline earth metal-containing composition (A) included in the fuel is an amount which is sufficient to reduce valve seat recession when the fuel is used in an internal combustion engine.

The following specific illustrative examples describe the preparation of exemplary alkali and alkaline earth metal compositions (A) useful in the fuel compositions of this invention.

EXAMPLE A-1

The neutral sodium salt of a polyisobutylene succinic acid wherein the molecular weight of the anionic portion is 950 is obtained as in U.S. Pat. No. 3,271,370.

EXAMPLE A-2

The neutral sodium salt of a polyisobutylene succinic acid wherein the molecular weight of the anionic portion is 500 is obtained as in U.S. Pat. No. 3,271,370. The sodium salt is employed to give a sodium equivalent ratio of 1.2 by using excess caustic.

EXAMPLE A-3

The neutral potassium salt of a polyisobutylene succinic acid wherein the molecular weight of the anionic portion is 1800 is obtained as in U.S. Pat. No. 3,271,370.
1

It is preferred that the compositions of this invention be phosphorus free to protect catalytic convertors and because the phosphorus component can generate salts which may raise the octane requirement of the engine. If desired, scavengers can be employed herein to reduce already formed deposits in the engine or to assist in maintaining the engine free of deposits. The materials which are useful herein as scavengers include halogenated hydrocarbons. The halogenated hydrocarbons may be aromatic or aliphatic conveniently containing from 1 to about 30 carbon atoms. The halogenated hydrocarbons may also include other moieties such as oxygen or sulfur provided such other moieties are not deleterious to the primary scavenging effect. Additional lead scavengers are hydrocarbon-soluble carbamates and 1,4 tertiary dialkylbenzenes.

The halogenated hydrocarbons are typically short chained alkyls and contain at least two halogen atoms per molecule of the scavenger. The halogen is preferably chlorine, or secondarily bromine. Mixtures of halogenated hydrocarbons are also useful herein. Suggested halogenated hydrocarbons include ethylene dichloride, ethylene dibromide, trichloromethane, tribromomethane, dichlorobenzene, trichlorobenzene and mixtures thereof. The use of ethylene dichloride and ethylene dibromide in a respective weight ratio of about 10:1 to about 1:10, preferably 7:1 to 1:7 is suggested. Additional halogenated materials include trichloro ethylene; 1,1,2-trichloro ethane; tetrachloro ethylene; 1,1,2,2-tetrachloro ethane; pentachloro ethane; hexachloro ethane; 1,2,4-trichloro benzene; 1,2,4,5-tetrachloro benzene; pentachloro benzene, chloroform, bromform, carbon tetrachloride and mixtures thereof.

The halogenated hydrocarbon is typically used with the alkali metal or alkaline earth metal containing composition on an equivalent ratio of the cation to the halogen. That is, for one mole of sodium, one half mole of ethylene dichloride would be utilized. For a calcium salt, two-thirds of a mole of trichlorobenzene is employed per mole of calcium in the salt.

Conveniently the equivalent ratio of the cation to the halogen present may vary from about 2:1 to about 1:15, preferably about 3:2 to about 1:7

The Hydrocarbon-Soluble Ashless Dispersant

The fuel compositions of the present invention desirably also contain a minor amount of at least one hydrocarbon soluble ashless dispersant. The compounds useful as ashless dispersants generally are characterized by a "polar" group attached to a relatively high molecular weight hydrocarbon chain. The "polar" group generally contains one or more of the elements nitrogen, oxygen and phosphorus. The solubilizing chains are generally higher in molecular weight than those employed with the metallic types, but in some instances they may be quite similar.

In general, any of the ashless detergents which are known in the art for use in lubricants and fuels can be utilized in the fuel compositions of the present invention.

In one embodiment of the present invention, the dispersant is selected from the group consisting of (i) at least one hydrocarbyl-substituted amine wherein the hydrocarbyl substituent is substantially aliphatic and contains at least 8 carbon atoms;
(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;
(iii) at least one nitrogen-containing condensate of a phenol, aldehyde and amino compound having at least one

—NH— group;
(iv) at least one ester of a substituted carboxylic acid;
(v) at least one polymeric dispersant;
(vi) at least one hydrocarbon substituted phenolic dispersant; and
(vii) at least one fuel soluble alkoxylated derivative of an alcohol, phenol or amine.

The Hydrocarbyl-Substituted Amine

The hydrocarbyl-substituted amines used in the fuel compositions of this invention are well known to those of skill in the art and they are described in a number of patents. Among these are U.S. Pat. Nos. 3,275,554; 3,438,757; 3,454,555; 3,565,804; 3,755,433 and 3,822,209. These patents disclose suitable hydrocarbyl amines for use in the present invention including their method of preparation.

A typical hydrocarbyl amine has the general formula:

$$[AXN]_x[-N([-UN-]_{hd}a[-UQ]_b)]_yR_c^2H_{1+2y+ay-c} \qquad \text{Formula VI}$$

wherein A is hydrogen, a hydrocarbyl group of from 1 to about 10 carbon atoms, or hydroxyhydrocarbyl group of from 1 to 10 carbon atoms; X is hydrogen, a hydrocarbyl group of from 1 to 10 carbon atoms, or hydroxyhydrocarbyl group of from 1 to 10 carbon atoms, and may be taken together with A and N to form a ring of from 5 to 6 annular members and up to 12 carbon atoms; U is an alkylene group of from 2 to 10 carbon atoms, any necessary hydrocarbons to accommodate the trivalent nitrogens are implied herein, $R^2$ is an aliphatic hydrocarbon of from about 30 to 400 carbon atoms; Q is a piperazine structure; a is an integer of from 0 to 10; b is an integer of from 0 to 1; a+2b is an integer of from 1 to 10; c is an integer of from about 1 to 5 and is an average in the range of 1 to 4, and equal to or less than the number of nitrogen atoms in the molecule; x is an integer of from 0 to 1; y is an integer of from about 0 to 1; and x+y is equal to 1.

In interpreting this formula, it is to be understood that the $R^2$ and H atoms are attached to the unsatisfied nitrogen valences within the brackets of the formula. Thus, for example, the formula includes subgeneric formulae wherein the R is attached to terminal nitrogens and isomeric subgeneric formula wherein it is attached to non-terminal nitrogen atoms. Nitrogen atoms not attached to an $R^2$ may bear a hydrogen or an AXN substituent.

The hydrocarbyl amines useful in this invention and embraced by the above formula include monoamines of the general formula:

$$AXNR^2 \qquad \text{Formula VII}$$

Illustrative of such monoamines are the following:

poly(propylene)amine
N,N-dimethyl-n-poly(ethylene/propylene)amine (50:50 mole ratio of monomers)
poly(isobutene)amine
N,N-di(hydroxyethyl)-N-poly(isobutene)amine
poly(isobutene/1-butene/2-butene)amine (50:25:25 mole ratio of monomer)
N-(2-hydroxyethyl)-N-poly(isobutene)amine
N-(2-hydroxypropyl)-N-poly(isobutene)amine
N-poly(1-butene)-aniline
N-poly(isobutene)-morpholine Among the hydrocarbyl amines embraced by the general Formula IX as set forth above, are polyamines of the general formula:

$$-N([-UN-]_a[-UQ]_b)R_c^2H_{1+2y+ay-c} \qquad \text{Formula VIII}$$

Illustrative of such polyamines are the following:

N-poly(isobutene) ethylene diamine
N-poly(propylene) trimethylene diamine
N-poly(1-butene) diethylene triamine
N',N'-poly(isobutene) tetraethylene pentamine
N,N-dimethyl-N'-poly(propylene), 1,3-propylene diamine The hydrocarbyl substituted amines useful in the fuel compositions of this invention include certain N-aminohydrocarbyl morpholines which are not embraced in the general Formula IX above. These hydrocarbyl-substituted aminohydrocarbyl morpholines have the general formula:

$$R^2N(A)UM \qquad \text{Formula IX}$$

wherein $R^2$ is an aliphatic hydrocarbon group of from about 30 to about 400 carbons, A is hydrogen, hydrocarbyl of from 1 to 10 carbon atoms or hydroxy hydrocarbyl group of from 1 to 10 carbon atoms, U is an alkylene group of from 2 to 10 carbon atoms, and M is a morpholine structure. These hydrocarbyl-substituted aminohydrocarbyl morpholines as well as the polyamines described by Formula VII are among the typical hydrocarbyl-substituted amines used in preparing compositions of this invention.

The Acylated Nitrogen-Containing Compounds

A number of acylated, nitrogen-containing compounds having a substituent of at least 10 aliphatic carbon atoms and made by reacting a carboxylic acid acylating agent with an amino compound are known to those skilled in the art. In such compositions the acylating agent is linked to the amino compound through an imido, amido, amidine or acyloxy ammonium linkage. The substituent of 10 aliphatic carbon atoms may be in either the carboxylic acid acylating agent derived portion of the molecule or in the amino compound derived portion of the molecule. Preferably, however, it is in the acylating agent portion. The acylating agent can vary from formic acid and its acylating derivatives to acylaing agents having high molecular weight aliphatic substituents of up to 5,000, 10,000 or 20,000 carbon atoms. The amino compounds can vary from ammonia itself to amines having aliphatic substituents of up to about 30 carbon atoms.

A typical class of acylated amino compounds useful in the compositions of this invention are those made by reacting an acylating agent having an aliphatic substituent of at least 10 carbon atoms and a nitrogen compound characterized by the presence of at least one —NH— group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The amine also may be a hydroxyalkyl-substituted polyamine. The aliphatic substituent in such acylating agents preferably averages at least about 30 or 50 and up to about 400 carbon atoms.

Illustrative hydrocarbon based groups containing at least ten carbon atoms are n-decyl, n-dodecyl, tetrapropenyl, n-octadecyl, oleyl, chlorooctadecyl, triicontanyl, etc. Generally, the hydrocarbon-based sub-stituents are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The substituent can also be derived from the halogenated (e.g., chlorinated or brominated) analogs of such homo- or interpolymers. The substituent can, however, be made from other sources, such as monomeric high molecular weight alkenes (e.g., 1-tetra-contene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the substituent may be reduced or eliminated by hydrogenation according to procedures known in the art.

As used in this specification and appended claims, the term "hydrocarbon-based" denotes a group having a carbon atom directly attached to the remainder of the molecule and having a predominantly hydrocarbon character within the context of this invention. Therefore, hydrocarbon-based groups can contain up to one non-hydrocarbon group for every ten carbon atoms provided this non-hydrocarbon group does not significantly alter the predominantly hydrocarbon character of the group. Those skilled in the art will be aware of such groups, which include, for example, hydroxyl, halo (especially chloro and fluoro), alkoxyl, alkyl mercapto, alkyl sulfoxy, etc. Usually, however, the hydrocarbon-based substituents are purely hydrocarbyl and contain no such non-hydrocarbyl groups.

The hydrocarbon-based substituents are substantially saturated, that is, they contain no more than one carbon-to-carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based substituents are also substantially aliphatic in nature, that is, they contain no more than one non-aliphatic moiety (cycloalkyl, cycloalkenyl or aromatic) group of six or less carbon atoms for every ten carbon atoms in the substituent. Usually, however, the substituents contain no more than one such non-aliphatic group for every fifty carbon atoms, and in many cases, they contain no such non-aliphatic groups at all; that is, the typical substituents are purely aliphatic. Typically, these purely aliphatic substituents are alkyl or alkenyl groups.

Specific examples of the substantially saturated hydrocarbon-based substituents containing an average of more than 30 carbon atoms are the following:

- a mixture of poly(ethylene/propylene) groups of about 35 to about 70 carbon atoms
- a mixture of the oxidatively or mechanically degraded poly(ethylene/propylene) groups of about 35 to about 70 carbon atoms
- a mixture of poly(propylene/1-hexene) groups of about 80 to about 150 carbon atoms
- a mixture of poly(isobutene) groups having an average of 50 to 75 carbon atoms.

A preferred source of the substituents are poly(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes contain predominantly (greater than 80% of total repeating units) isobutene repeating units of the configuration:

$$-C(CH_3)_2CH_2 \qquad \text{Formula X}$$

Exemplary of amino compounds useful in making these acylated compounds are the following:

(1) polyalkylene polyamines of the general formula:

$$(R^3)_2N[U-N(R^3)]_nR^3 \qquad \text{Formula XI}$$

wherein each $R^3$ is independently a hydrogen atom, a hydrocarbyl group or a hydroxy-substituted hydrocarbyl group containing up to about 30 carbon atoms, with proviso that at least one $R^3$ is a hydrogen atom, n is a whole number of 1 to 10 and U is a $C_{1-18}$ alkylene group, (2) heterocyclic-substituted polyamines including hydroxyalkyl-substituted polyamines wherein the polyamines are described above and the heterocyclic substituent is e.g., a piperazine, an imidazoline, a pyrimidine, a morpholine, etc., and (3) aromatic polyamines of the general formula:

$$Ar(NR_2^3)_y \qquad \text{Formula XII}$$

wherein Ar is a aromatic nucleus of 6 to about 20 carbon atoms, each $R^{3'''}$ is as defined hereinabove and y is 2 to about 8. Specific examples of the polyalkylene polyamines (1) are ethylene diamine, tetra(ethylene)pentamine, tri-(trimethylene)tetramine, 1,2-propylene diamine, etc. Specific examples of hydroxyalkyl-substituted polyamines include N-(2-hydroxyethyl) ethylene diamine, $N,N^1$-bis(2-hydroxyethyl) ethylene diamine, N-(3-hydroxybutyl) tetramethylene diamine, etc. Specific examples of the heterocyclic-substituted polyamines (2) are N-2-aminoethyl piperazine, N-2 and N-3 amino propyl morpholine, N-3(dimethyl amino) propyl piperazine, 2-heptyl-3-(2-aminopropyl) imidazoline, 1,4-bis (2-aminoethyl) piperazine, 1-(2-hydroxy ethyl) piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; 3,804,763 and 4,234,435. A typical acylated nitrogen-containing compound of this class is that made by reacting a poly(isobutene)-substituted succinic anhydride acylating agent (e.g., anhydride, acid, ester, etc.) wherein the poly(isobutene) substituent has between about 50 to about 400 carbon atoms with a mixture of ethylene polyamines having 3 to about 7 amino nitrogen atoms per ethylene polyamine and about 1 to about 6 ethylene chloride. In view of the extensive disclosure of this type of acylated amino compound, further discussion of their nature and method of preparation is not needed here. The above-noted U.S. Patents are utilized for their disclosure of acylated amino compounds and their method of preparation.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the monocarboxlyic acid are formic acid, acetic acid, dodecanoic acid, butanoic acid, oleic acid, stearic acid, the commercial mixture of stearic acid isomers known as isostearic acid, tolyl acid, etc. Such materials are more fully described in U.S. Pat. Nos. 3,216,936 and 3,250,715.

Still another type of acylated nitrogen compound useful in making the fuels of this invention is the product of the reaction of a fatty monocarboxylic acid of about 12–30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12–30 carbon atoms. A widely used type of acylated nitrogen compound is made by reacting the afore-described alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a by-product from the dimerization of unsaturated fatty acids as described in U.S. Pat. Nos. 2,812,342 and 3,260,671.

The branched chain fatty acids can also include those in which the branch is not alkyl in nature, such as found in phenyl and cyclohexyl stearic acid and the chlorostearic acids. Branched chain fatty carboxylic acid-/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are utilized for their disclosure of fatty acid/polyamine condensates for their use in lubricating oil formulations.

The Nitrogen-Containing Condensates of Phenols, Aldehydes, and Amino Compounds The phenol/aldehyde/amino compound condensates useful as dispersants in the fuel compositions of this invention include those generically referred to as Mannich condensates. Generally they are made by reacting simultaneously or sequentially at least one active hydrogen compound such as a hydrocarbon-substituted phenol (e.g., and alkyl phenol wherein the alkyl group has at least an average of about 12 to 400; preferably 30 up to about 400 carbon atoms), having at least one hydrogen atom bonded to an aromatic carbon, with at least one aldehyde or aldehyde-producing material (typically formaldehyde precursor) and at least one amino or polyamino compound having at least one NH group. The amino compounds include primary or secondary monoamines having hydrocarbon substituents of 1 to 30 carbon atoms or hydroxyl-substituted hydrocarbon substituents of 1 to about 30 carbon atoms. Another type of typical amino compound are the polyamines described during the discussion of the acylated nitrogen-containing compounds.

Exemplary mono-amines include methyl ethyl amine, methyl octadecyl amines, aniline, diethyl amine, diethanol amine, dipropyl amine and so forth. The following U.S. Patents contain extensive descriptions of Mannich condensates which can be used in making the compositions of this invention:

| U.S. PAT. NOS. | | |
|---|---|---|
| 2,459,112 | 3,413,347 | 3,558,743 |
| 2,962,442 | 3,442,808 | 3,586,629 |
| 2,984,550 | 3,448,047 | 3,591,598 |
| 3,036,003 | 3,454,497 | 3,600,372 |
| 3,166,516 | 3,459,661 | 3,634,515 |
| 3,236,770 | 3,461,172 | 3,649,229 |
| 3,355,270 | 3,493,520 | 3,697,574 |
| 3,368,972 | 3,539,633 | |

Condensates made from sulfur-containing can be used in the fuel compositions of the present invention. Such sulfur-containing condensates are described in U.S. Pat. Nos. 3,368,972; 3,649,229; 3,600,372; 3,649,659 and 3,741,896. These patents also disclose sulfur-containing Mannich condensates. Generally the condensates used in making compositions of this invention are made from a phenol bearing an alkyl substituent of about 6 to about 400 carbon atoms, more typically, 30 to about 250 carbon atoms. These typical condensates are made from formaldehyde or $C_{2-7}$ aliphatic aldehyde and an amino compound such as those used in making the acylated nitrogen-containing compounds described under (B)(ii).

These preferred condensates are prepared by reacting about one molar portion of phenolic compound with about 1 to about 2 molar portions of aldehyde and about 1 to about 5 equivalent portions of amino compound (an equivalent of amino compound is its molecular weight divided by the number of =NH groups present). The conditions under which such condensation reactions are carried out are well known to those skilled in the art as evidenced by the above-noted patents. Therefore, these patents are also incorporated by reference for their disclosures relating to reaction conditions.

A particularly preferred class of nitrogen-containing condensation products for use in the fuels of the present invention are those made by a "2-step process" as disclosed in commonly assigned U.S. Ser. No. 451,644, filed Mar. 15, 1974 now abandoned. Briefly, these nitrogen-containing condensates are made by (1) reacting at least one hydroxy aromatic compound containing an aliphatic-based or cycloaliphatic-based substituent which has at least about 30 carbon atoms and up to about 400 carbon atoms with a lower aliphatic $C_{1-7}$ aldehyde or reversible polymer thereof in the presence of an alkaline reagent, such as an alkali metal hydroxide, at a temperature up to about 150° C.; (2) substantially neutralizing the intermediate reaction mixture thus formed; and (3) reacting the neutralized intermediate with at least one compound which contains an amino group having at least one —NH— group.

More preferably, these 2-step condensates are made from (a) phenols bearing a hydrocarbon-based substituent having about 30 to about 250 carbon atoms, said substituent being derived from a polymer of propylene, 1-butene, 2-butene, or isobutene and (b) formaldehyde, or reversible polymer thereof, (e.g., trioxane, paraformaldehyde) or functional equivalent thereof, (e.g., methylol) and (c) an alkylene polyamine such as ethylene polyamines having between 2 and 10 nitrogen atoms. Further details as to this preferred class of condensates can be found in the hereinabove noted U.S. Ser. No. 451,644, which is hereby incorporated by reference, for its disclosures relating to 2-step condensates.

The Esters of Substituted Carboxylic Acids

The esters useful as detergents/dispersants in this invention are derivatives of substituted carboxylic acids in which the substituent is a substantially aliphatic, substantially saturated hydrocarbon-based group containing at least about 30 (preferably about 50 to about 750) aliphatic carbon atoms. As used herein, the term "hydrocarbon-based group" denotes a group having a carbon atom directly attached to the remainder of the molecule and having predominantly hydrocarbon character within the context of this invention. Such groups include the following:

(1) Hydrocarbon groups; that is, aliphatic groups, aromatic- and alicyclic-substituted aliphatic groups, and the like, of the type know to those skilled in the art.

(2) Substituted hydrocarbon groups; that is, groups containing non-hydrocarbon substituents which, in the context of this invention, do not alter the predominantly hydrocarbon character of the group. Those skilled in the art will be aware of suitable substituents; examples are halo, nitro, hydroxy, alkoxy, carbalkoxy and alkylthio.

(3) Hetero groups; that is, groups which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based group.

The substituted carboxylic acids (and derivatives thereof including esters, amides and imides) are normally prepared by the alkylation of an unsaturated acid, or a derivative thereof such as an anhydride, ester, amide or imide, with a source of the desired hydrocarbon-based group. Suitable unsaturated acids and derivatives thereof include acrylic acid, methacrylic acid, maleic acid, maleic anhydride, fumaric acid, itaconic acid, itaconic anhydride, citraconic acid, citraconic anhydride, mesaconic acid, glutaconic acid, chloromaleic acid, aconitic acid, crotonic acid, methylcrotonic acid, sorbic acid, 3-hexenoic acid, 10-decenoic acid and 2-pentene-1,3,5-tricarboxylic acid. Particularly preferred are the unsaturated dicarboxylic acids and their derivatives, especially maleic acid, fumaric acid and maleic anhydride.

Suitable alkylating agents include homopolymers and interpolymers of polymerizable olefin monomers containing from about 2 to about 10 and usually from about 2 to about 6 carbon atoms, and polar substituent-containing derivatives thereof. Such polymers are substantially saturated (i.e., they contain no more than about 5% olefinic linkages) and substantially aliphatic (i.e., they contain at least about 80% and preferably at least about 95% by weight of units derived from aliphatic monoolefins). Illustrative monomers which may be used to produce such polymers are ethylene, propylene, 1-butene, 2-butene, isobutene, 1-octene and 1-decene. Any unsaturated units may be derived from conjugated dienes such as 1,3-butadiene and isoprene; non-conjugated dienes such as 1,4-hexadiene, 1,4-cyclohexadine, 5-ethylidene-2-norbornene and 1,6-octadiene: and trienes such as 1-isopropylidene-3a,4,7,-7a-tetrahydroindene, 1-isopropylidenedicyclopentadiene and 2-(2-methylene-4-methyl-3-pentenyl) [2.2.1]bicyclo-5-heptene.

A first preferred class of polymers comprises those of terminal olefins such as propylene, 1-butene, isobutene and 1-hexene. Especially preferred within this class are polybutenes comprising predominantly isobutene units. A second preferred class comprises terpolymers of ethylene, a $c_{3-8}$ alpha-monoolefin and a polyene selected from the group consisting of non-conjugated dienes (which are especially preferred) and trienes. Illustrative of these terpolyers is "Ortholeum 2052" manufactured by E.I. duPont de Nemours & Company, which is a terpolymer containing about 48 mole percent ethylene groups, 48 mole percent propylene groups and 4 mole percent 1,4-hexadiene groups and having an inherent viscosity of 1.35 (8.2 grams of polymer in 10 ml. of carbon tetrachloride at 30° C.).

Methods for the preparation of the substituted carboxylic acids and derivatives thereof are well known in the art and need not be described in detail. Reference is made, for example, to U.S. Pat. Nos. 3,272,746; 3,522,179; and 4,234,435 which are incorporated by reference herein. The mole ratio of the polymer to the unsaturated acid or derivative thereof may be equal to, greater than or less than 1, depending on the type of product desired.

The esters are those of the above-described succinic acids with hydroxy compounds which may be aliphatic compounds such as monohydric and polyhydric alcohols or aromatic compounds such as phenols and naphthols. The aromatic hydroxy compounds from which the esters of this invention may be derived are illustrated by the following specific examples: phenol, beta-naphthol, alpha-naphthol, cresol, resorcinol, catechol, p,p'dihydroxybiphenyl, 2-chlorophenol, 2,4-dibutylphenol, propene tetramer-substituted phenol, didodecylphenol, 4,4'-methylene-bis-phenol, alpha-decyl-beta-naphthol, polyisobutene (molecular weight of 1000)-substituted phenol, the condensation product of heptylphenol with 0.5 mole of formaldehyde, the condensation product of octylphenol with acetone, di(hydroxyphenyl)-oxide, di(hydroxy-phenyl)sulfide, di(hydroxyphenyl)disulfide, and 4-cyclo-hexylphenol. Phenol and alkylated phenols having up to three alkyl substituents are preferred. Each of the alkyl substituents may contain 100 or more carbon atoms.

The alcohols from which the esters may be derived preferably contain up to about 40 aliphatic carbon atoms. They may be monohydric alcohols such as methanols, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, monooleate of ethylene glycol, monostearate of diethylene glycol, secpentyl alcohol, tertbutyl alcohol, 5-bromo-dodecanol, nitro-octadecanol and dioleate of glyceol. The polyhydric alcohols preferably contain from 2 to about 10 hydroxy radicals. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, 9,10-dihydroxy stearic acid, methyl ester of 9,10-dihydroxy stearic acid, 1,2-butanediol, 2,3-hexanediol, 2,4-hexanediol, penacol, erythritol, arabitol, sorbitol, mannitol, 1,2-cyclo-hexanediol, and xylene glycol. Carbohydrates such as sugars, starches, cellulose, etc., likewise may yield the esters of this invention. The carbohydrates may be exemplified by a glucose, fructose, sucrose, rhamnose, mannose, glyceraldehyde, and galactose.

An especially preferred class of polyhydric alcohols are those having at least three hydroxy radicals, some of which have been esterified with a monocarboxylic acid having from about 8 to about 30 carbon atoms, such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The esters may also be derived from unsaturated alcohols such as allyl alcohol, cinnamyl alcohol, propargyl alcohol, 1-cyclohexene-3-ol, an oleyl alcohol. Still another class of the alcohols capable of yielding the esters of this invention comprise the ether-alcohols and amino-alcohols including, for example, the oxyalkylene-, oxyarylene-, amino-alkylene-, and amino-arylene-substituted alcohols having one or more oxy-alkylene, amino-alkylene or amino-arylene oxy-arylene radicals. They are exemplified by Cellosolve, carbitol, phenoxyethanol, heptylphenyl-(oxypropylene)$_6$-H, octyl-(oxyethylene)$_{30}$-H, phenyl-(oxyoctylene)$_2$-H, mono(heptylphenyloxypropylene)-substituted glycerol, poly(styrene oxide), amino-ethanol, 3-amino ethyl-pentanol, di(hydroxyethyl) amine, p-amino-phenol, tri(hydroxypropyl-)amine, N-hydroxyethyl ethylene diamine, N,N,N',N'tetrahydroxy-trimethylenediamine, and the like. For the most part, the etheralcohols having up to about 150 oxyalkylene radicals in which the alkylene radical contains from 1 to about 8 carbon atoms are preferred.

The esters may be di-esters of succinic acids or acidic esters, i.e., partially esterified polyhydric alcohols or phenols, i.e., esters having free alcoholic or phenolic hydroxyl radicals. Mixtures of the above-illustrated esters likewise are contemplated within the scope of the invention.

The esters may be prepared by one of several methods. The method which is preferred because of convenience and superior properties of the esters it produces, involves the reaction of a suitable alcohol or phenol with a substantially hydrocarbon-substituted succinic anhydride. The esterification is usually carried out at a temperature above about 100° C, preferably between 150° C. and 300° C.

The water formed as a by-product is removed by distillation as the esterification proceeds. A solvent may be used in the esterification to facilitate mixing and temperature control. It also facilitates the removal of water from the reaction mixture. The useful solvents include xylene, toluene, diphenyl ether, chlorobenzene, and mineral oil.

A modification of the above process involves the replacement of the substituted succinic anhydride with the corresponding succinic acid. However, succinic acids readily undergo dehydration at temperatures above about 100° C. and are thus converted to their anhydrides which are then esterified by the reaction with the alcohol reactant. In this regard, succinic acids appear to be the substantial equivalent of their anhydrides in the process.

The relative proportions of the succinic reactant and the hydroxy reactant which are to be used depend to a large measure upon the type of the product desired and the number of hydroxyl groups preset in the molecule of the hydroxy reactant. For instance, the formation of a half ester of a succinic acid, i.e., one in which only one of the two acid radicals is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl radicals of the alcohol is esterified with one of the two acid radicals of the succinic acid. Thus, the maximum proportion of the succinic acid to be used with a polyhydric alcohol is determined by the number of hydroxyl groups present in the molecule of the hydroxy reactant. For the purposes of this invention, it has been found tha esters obtained by the reaction of equimolar amounts of the succinic acid reactant and hydroxy reactant have superior properties and are therefore preferred.

In some instances, it is advantageous to carry out the esterification in the presence of a catalyst such as sulfuric acid, pyridine hydrochloride, hydrochloric acid, benzenesulfonic acid, p-toluenesulfonic acid, phosphoric acid, or any other known esterification catalyst. The amount of the catalyst in the reaction may be as little as 0.01% (by weight of the reaction mixture), more often from about 0.1% to about 5%.

The esters of this invention likewise may be obtained by the reaction of a substituted succinic acid or anhydride with an epoxide or a mixture of a epoxide and water. Such reaction is similar to one involving the acid or anhydride with a glycol. For instance, the product may be prepared by the reaction of a substituted succinic acid with one mole of ethylene oxide. Similarly, the product may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soya bean oil, methyl ester of 9,10-epoxy-stearic acid, and butadiene mono-epoxide. For the most part, the epoxides are the alkylene oxides in which the alkylene radical has from 2 to about 8 carbon atoms; or the epoxidized fatty acid esters in which the fatty acid radical has up to about 30 carbon atoms and the ester radical is derived from a lower alcohol having up to about 8 carbon atoms.

In lieu of the succinic acid or anhydride, a lactone acid or a substituted succinic acid halide may be used in the processes illustrated above for preparing the esters of this invention. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from about 100° C. to about 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from about 100° C. to about 250° C. The succinic acid halides can be prepared by the reaction of the acids or their anhydrides with a halogenation agent such as phosphorous tribromide, phosphorus pentechloride, or thionyl chloride. These and other methods of preparing the succinic compounds are well known in the art and need not be illustrated in further detail here.

Still other methods of preparing the esters useful in the fuels of this invention are available. For instance, the esters may be obtained by the reaction of maleic acid or anhydride with an alcohol such as is illustrated above to form a mono- or di-ester of maleic acid and then the reaction of this ester with an olefin or a chlorinated hydrocarbon such as is illustrated above. They may also be obtained by first esterifying itaconic anhydride or acid and subsequently reacting the ester intermediate with an olefin or a chlorinated hydrocarbon under conditions similar to those described hereinabove.

The Polymeric Dispersants

A large number of different types of polymeric dispersants have been suggested as useful in lubricating oil formulations, and such polymeric dispersants are useful in the fuel compositions of the present invention. Often, such additives have been described as being useful in lubricating formulations as viscosity index improvers with dispersing characteristics. The polymeric dispersants generally are polymers or copolymers having a long carbon chain and containing "polar" compounds to impart the dispersancy characteristics. Polar groups which may be included include amines, amides, imines, imides, hydroxyl, ether, etc. For example, the polymeric dispersants may be copolymers of methacrylates or acrylates containing additional polar groups, ethyleneprepylene copolymers containing polar groups or vinyl acetatefumaric acid ester copolymers.

Many such polymeric dispersants have been described in the prior art, and it is not believed necessary to list in detail the various types. The following are examples of patents describing polymeric dispersants. U.S. Pat. No. 4,402,844 describes nitrogen-containing copolymers prepared by the reaction of lithiated hydrogenated conjugated dienemonovinylarene copolymers with substituted aminolactans. U.S. Pat. No. 3,356,763 describes a process for producing block copolymers of dienes such as 1,3-butadiene and vinyl aromatic hydrocarbons such as ethyl styrenes. U.S. Pat. No. 3,891,721 describes block polymers of styrene-butadiene-2-vinyl pyridine.

A number of the polymeric dispersants may be prepared by the grafting polar monomers to polyolefinic backbones. For example, U.S. Pat. Nos. 3,687,849 and 3,687,905 describe the use of maleic anhydrides as a graft monomer to a polyolefinic backbone. Maleic acid or anhydride is particularly desirable as a graft monomer because this monomer is relatively inexpensive, provides an economical route to the incorporation of dispersant nitrogen compounds into polymers by further reaction of the carboxyl groups of the maleic acid or anhydride with, for example, nitrogen compounds or hydroxy compounds. U.S. Pat. No. 4,160,739 describes graft copolymers obtained by the grafting of a monomer system comprising maleic acid or anhydride and at least one other different monomer which is addition copolymerizable therewith, the grafted monomer system then being post-reacted with a polyamine. The monomers which are copolymerizable with maleic acid or anhydride are any alpha, beta-monoethylenically unsaturated monomers which are sufficiently soluble in the reaction medium and reactive towards maleic acid or anhydride so that substantially larger amounts of maleic acid or anhydride can be incorporated into the grafted polymeric product. Accordingly, suitable monomers include the esters, amides and nitriles of acrylic and methacrylic acid, and monomers containing no free acid groups. The inclusion of heterocyclic monomers into graft polymers is described by a process which comprises a first step of graft polymerizing an alkyl ester of acrylic acid or methacrylic acid, alone or an combination with styrene, onto a backbone copolymer which is a hydrogenated block copolymer of styrene and a conjugated diene having 4 to 6 carbon atoms to form a first graft polymer. In the second step, a polymerizable hetero-cyclic monomer, alone or in combination with a hydro-phobizing vinyl ester is co-polymerized onto the first graft copolymer to form a second graft copolymer.

Other patents describing graft polymers useful as dispersants in the fuels of this invention include U.S. Pat. Nos. 3,243,481; 3,475,514; 3,723,575; 4,026,167; 4,085,055; 4,181,618; and 4,476,283.

Another class of polymeric dispersant useful in the fuel compositions of the invention are the so-called "star" polymers and copolymers. Such polymers are described in, for example, U.S. Pat. Nos. 4,346,193, 4,141,847, 4,358,565, 4,409,120 and 4,077,893. All of the above patents relating to polymeric dispersants are utilized for their disclosure of suitable polymeric dispersants which can be utilized in the fuels of this invention.

The Hydrocarbon-Substituted Phenolic Dispersant

The hydrocarbon-substituted phenolic dispersants useful in the fuel compositions of the present invention include the hydrocarbon-substituted phenolic compounds wherein the hydrocarbon substituents have a molecular weight which is sufficient to render the phenolic compound fuel soluble. Generally, the hydrocarbon substituent will be a substantially saturated, hydrocarbon-based group of at least about 30 carbon atoms. The phenolic compounds may be represented generally by the following formula:

$$(R)_a—Ar—(OH)_b \qquad \text{Formula XIII}$$

wherein R is a substantially saturated hydrocarbon-based substituent having an average of from about 30 to about 400 aliphatic carbon atoms, and a and b are each, 1, 2 or 3. Ar is an aromatic moiety such as a benzene nucleus naphthalene nucleus or linked benzene nuclei. Optionally, the above phenates as represented by Formula XIII may contain other substituents such as lower alkyl groups, lower alkoxyl, nitro, amino, and halo groups. Preferred examples of optional substituents are the nitro and amino groups.

The substantially saturated hydrocarbon-based group R in Formula XIII may contain up to about 750 aliphatic carbon atoms although it usually has a maximum of an average of about 400 carbon atoms. In some instances R has a minimum of about 50 carbon atoms. As noted, the phenolic compounds may contain more than one R group for each aromatic nucleus in the aromatic moiety Ar.

Generally, the hydrocarbon-based groups R are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins. The R groups can also be derived from the halogenated (e.g., chlorinated or brominated) analogs of such homo- or interpolymers. The R groups can, however, be made from other sources, such as monomeric high molecular weight alkenes (e.g. 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly-(ethylene) greases) and other sources known to those skilled in the art. Any unsaturation in the R groups may be reduced or eliminated by hydrogenation according to procedures known in the art before the nitration step described hereafter.

Specific examples of the substantially saturated hydrocarbon-based R groups are the following:

- a tetracontanyl group
- a henpentacontanyl group
- a mixture of poly(ethylene/propylene) groups of about 35 to about 70 carbon atoms a mixture of the oxidatively or mechanically degraded poly-(ethylene/propylene) groups of about 35 to about 70 carbon atoms a mixture of poly(propylene/1-hexene) groups of about 80 to about 150 carbon atoms a mixture of poly(isobutene) groups having between 20 and 32 carbon atoms a mixture of poly(isobutene) groups having an average of 50 to 75 carbon atoms.

A preferred source of the group R are poly-(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoide. These polybutenes contain predominantly (greater than 80% of total repeat units) isobutene repeating units of the configuration.

$$-C(CH_3)_2CH_2- \qquad \text{Formula X}$$

The attachment of the hydrocarbon-based group R to the aromatic moiety Ar of the amino phenols of this invention can be accomplished by a number of techniques well known to those skilled in the art.

In one preferred embodiment, the phenolic dispersants useful in the fuels of the present invention are hydrocarbon-substituted nitro phenols as represented by Formula XV wherein the optional substituent is one or more nitro groups. The nitro phenols can be conveniently prepared by nitrating appropriate phenols, and typically, the nitro phenols are formed by nitration of alkyl phenols having an alkyl group of at least about 30 and preferably about 50 carbon atoms. The preparation of a number of hydrocarbon-substituted nitro phenols useful in the fuels of the present invention is described in U.S. Pat. No. 4,347,148.

In another preferred embodiment, the hydrocarbon-substituted phenol dispersants useful in the present invention are hydrocarbon-substituted amino phenols such as represented by Formula XV wherein the optional substituent is one or more amino groups. These amino phenols can conveniently be prepared by nitrating an appropriate hydroxy aromatic compound as described above and there after reducing the nitro groups to amino groups. Typically, the useful amino phenols are formed by nitration and reduction of alkyl phenols having an alkyl or alkenyl group of at least about 30 and preferably about 50 carbon atoms. The preparation of a large number of hydrocarbon-substituted amino phenols useful as dispersants in the present invention is described in U.S. Patent 4,320,021.

The Fuel-Soluble Alkoxylated Derivatives of Alcohols, Phenols or Amines

Also useful as dispersants in the fuel compositions of the present invention are fuel-soluble alkoxy-lated derivatives of alcohols, phenols and amines. A wide variety of such derivatives can be utilized as long as the derivatives are fuel-soluble. More preferably, the derivatives in addition to being fuel-soluble should be water-insoluble. Accordingly, in a preferred embodiment, the fuel-soluble alkoxylated derivatives useful as the dispersants are characterized as having an HLB of from 1 to about 13.

As is well known to those skilled in the art, the fuel-solubility and water-insolubility characteristics of the alkoxylated derivatives can be controlled by selection of the alcohol or phenols and amines, selection of the particular alkoxy reactant, and by selection of the amount of alkoxy reactant which is reacted with the alcohols, phenols and amines. Accordingly, the alcohols which are utilized to prepare the alkoxylated derivatives are hydrocarbon based alcohols while the amines are hydrocarbyl-substituted amines such as, for example, the hydrocarbyl-substituted amines described above as dispersant (B)(i). The phenols may be phenols or hydrocarbon-substituted phenols and the hydrocarbon substituent may contain as few as 1 carbon atom.

The alkoxylated derivatives are obtained by reacting the alcohol, phenol or amine with an epoxide or a mixture of an epoxide and water. For example, the derivative may be prepared by the reaction of the alcohol, phenol or amine with an equal molar amount or an excess of ethylene oxide. Other epoxides which can be reacted with the alcohol, phenol or amine include, for example, propylene oxide, styrene oxide, 1,2-butylene oxide, 2,3-butylene oxide, epichlorohydrin, cyclohexene oxide, 1,2-octylene oxide, etc. Preferably, the epoxides are the alkylene oxides in which the alkylene group has from about 2 to about 8 carbon atoms. As mentiondd above, it is desirable and preferred that the amount of alkylene oxide reacted with the alcohol, phenol or amine be insufficient to render the derivative water-soluble.

The following are examples of commercially available alkylene oxide derivatives which may be utilized as dispersants in the fuel compositions of the present invention: Ethomeen S/12, tertiary amines ethylene oxide condensation products of the primary fatty amines (HLB, 4.15; Armak Industries); Plurafac A-24, an oxyethylated straight-chain alcohol available from BASF Wyandotte Industries (HLB 5.0); etc. Other suitable fuel-soluble alkoxylated derivatives of alcohols, phenols and amines will be readily apparent to those skilled in the art.

The following specific examples illustrate the preparation of exemplary dispersants useful in the fuel compositions of this invention.

EXAMPLE B-1

A mixture of 1500 parts of chlorinated poly(isobutene) having a molecular weight of about 950 and a chlorine content of 5.6%, 285 parts of an alkylene polyamine having an average composition corresponding stoichiometrically to tetraethylene pentamine and 1200 parts of benzene is heated to reflux. The temperature of the mixture is then slowly increased over a 4-hour period to 170° C. while benzene is removed. The cooled mixture is diluted with an equal volume of mixed hexanes and absolute ethanol (1:1). The mixture is heated to reflux and ⅓ volume of 10% aqueous sodium carbonate is added to the mixture. After stirring, the mixture is allowed to cool and phase separate. The organic phase is washed with water and stripped to provide the desired polyisobutenyl polyamine having a nitrogen content of 4.5% by weight.

EXAMPLE B-2

A mixture of 140 parts of toluene and 400 parts of a polyisobutenyl succinic anhydride (prepared from the poly(isobutene) having a molecular weight of about 850, vapor phase osmometry) having a saponification number 109, and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7% by weight.

EXAMPLE B-3

To 1,133 parts of commercial diethylene triamine heated at 110°-150° C. is slowly added 6820 parts of isostearic acid over a period of two hours. The mixture is held at 150° C. for one hour and then heated to 180° C. over an additional hour. Finally, the mixture is heated to 205° C. over 0.5 hour; throughout this heating, the mixture is blown with nitrogen to remove volatiles. The mixture is held at 205°-230° C. for a total of 11.5 hours and the stripped at 230° C./20 torr (2.65KPa) to provide the desired acylated polyamine as residue containing 6.2% nitrogen by weight.

EXAMPLE B-4

To a mixture of 50 parts of a polypropyl-substituted phenol (having a olecular weight of about 900, vapor phase osmometry), 500 parts of mineral oil (a solvent refined paraffinic oil having a viscosity of 100 SUS at 100° F.) and 130 parts of 9.5% aqueous dimethylamine solution (equivalent to 12 parts amine) is added dropwise, over an hour, 22 parts of a 37% aqueous solution of formaldehyde (corresponding to 8 parts aldehyde). During the addition, the reaction temperature is slowly increased to 100° C. and held at that point for three hours while the mixture is blown with nitrogen. To the cooled reaction mixture is added 100 parts toluene and 50 parts mixed butyl alcohols. The organic phase is washed three times with water until neutral to litmus paper and the organic phase filtered and stripped to 200° C./5-10 (0.66-1.33KPa) torr. The residue is an oil solution of the final product containing 0.45% nitrogen by weight.

EXAMPLE B-5

A mixture of 140 parts of a mineral oil, 174 parts of a poly(isobutene)-substituted succinic anhydride (molecular weight 1000) having a saponification number of 105 and 23 parts of isostearic acid is prepared at 90° C. To this mixture there is added 17.6 parts of a mixture of polyalkylene amines having an overall composition corresponding to that of tetraethylene pentamine at 80°-100° C. throughout a period of 1.3 hours. The reaction is exothermic. The mixture is blown at 225° C. with nitrogen at a rate of 5 pounds (2.27 Kg) per hour for 3 hours whereupon 47 parts of an aqueous distillate is obtained. The mixture is dried at 225° C. for 1 hour, cooled to 100° C. and filtered to provide the desired final product in oil solution.

EXAMPLE B-6

A substantially hydrocarbon-substituted succinic anhydride is prepared by chlorinating a polyisobutene having a molecular weight of 1000 to a chlorine content of 4.5% and then heating the chlorinated polyisobutene with 1.2 molar proportions of maleic anhydride at a temperature of 150°-220° C. The succinic anhydride thus obtained has an acid number of 130. A mixture of 874 grams (1 mole) of the succinic anhydride and 104 grams (1 mole) of neopentyl glycol is mixed at 240°-250° C./30 mm (4 KPa) for 12 hours. The residue is a mixture of the esters resulting from the esterification of one and both hydroxy radicals of the glycol. It has a saponification number of 101 and an alcoholic hydroxyl content of 0.2% by weight.

EXAMPLE B-7

The dimethyl ester of the substantially hydrocarbon-substituted succinic anhydride of Example B-2 is prepared by heating a mixture of 2185 grams of the anhydride, 480 grams of methanol, and 1000 cc. of toluene at 50°-65° C. while hydrogen chloride is bubbled through the reaction mixture for 3 hours. The mixture is then heated at 60°-65° C. for 2 hours, dissolved in benzene, washed with water, dried and filtered. The filtrate is heated at 150° C./60 mm (8 KPa) to rid it of volatile components. The residue is the defined dimethyl ester.

EXAMPLE B-8

A carboxylic acid ester is prepared by slowly adding 3240 parts of a high molecular weight carboxylic acid (prepared by reacting chlorinated polyisobutylene and acrylic acid in a 1:1 equivalent ratio and having an average molecular weight of 982) to a mixture of 200 parts of sorbitol and 100 parts of diluent oil over a 1.5-hour period while maintaining a temperature of 115°-125° C. Then 400 parts of additional diluent oil are added and the mixture is maintained at about 195°-205° C. for 16 hours while blowing the mixture with nitrogen. An additional 755 parts of oil are then added, the mixture cooled to 140° C., and filtered. The filtrate is an oil solution of the desired ester.

EXAMPLE B-9

An ester is prepared by heating 658 parts of a carboxylic acid having an average molecular weight of 1018 (prepared by reacting chlorinated polyisobutene with acrylic acid) with 22 parts of pentaerythritol while maintaining a temperature of about 180°-205° C. for about 18 hours during which time nitrogen is blown through the mixture. The mixture is then filtered and the filtrate is the desired ester.

EXAMPLE B-10

To a mixture comprising 408 parts of pentaerythritol and 1100 parts oil heated to 120° C., there is slowly added 2946 parts of the acid of Example B-9 which has been preheated to 120° C., 225 parts of xylene, and 95 parts of diethylene glycol dimethylether. The resulting mixture is heated at 195°-205° C., under a nitrogen atmosphere and reflux conditions for eleven hours, stripped to 140° C. at 22 mm (2.92 KPa) (Hg) pressure, and filtered. The filtrate comprises the desired ester. It is diluted to a total oil content of 40%.

As mentioned above, the fuel compositions of the present invention comprise a major amount of liquid hydrocarbon fuel and a minor amount of at least one hydrocarbon soluble alkali or alkaline earth metal-containing composition as described above.

The present invention is particularly relevant to fuel compositions which are unleaded or low-lead gasolines. For the purposes of the present specification and claims, the term "unleaded" is used to indicate that no lead compounds such as tetraethyl lead or tetramethyl lead have been added intentionally to the fuel. The term "low-lead", indicates that the fuel contains less than about 0.5 (preferably 0.03) gram of lead per gallon of fuel. The present invention is particularly useful for low-lead fuel compositions containing as little as 0.1 gram of lead per gallon (0.0264 g/liter) of fuel.

The amount of the hydrocarbon soluble alkali or alkaline earth metal-containing composition (A) included in the fuel compositions of the present invention may vary over a wide range although it is preferred not to include unnecessarily large excesses of the metal composition. The amount included in the fuel should be an amount sufficient to improve the desired properties such as the reduction of valve seat recession when the fuel is burned in internal combustion engines which are not designed for use with unleaded gas. For example, older engines which were designed for leaded fuels were not constructed with specially hardened valve seats. Accordingly, the amount of metal composition to be included in the fuel will depend in part on the amount of lead in the fuel. For unleaded fuels, large amounts of the metal composition are required to provide the desirable reduction in valve seat recession. When low-lead fuels are treated in accordance with the present invention, lesser amounts of the metal-containing composition generally are required.

In summary, the amount of component (A) included in the fuel compositions of the present invention will be an amount which is sufficient to reduce valve seat recession when such fuels are utilized in an internal combustion engine. Generally, the fuel will contain less than about 0.2 gram preferably, less than 0.1 gram of the alkali or alkaline earth metal compound per liter of fuel. In another embodiment, the fuel composition of the present invention will contain from about 1 to about 100 parts of the alkali metal or alkaline earth metal per million parts of fuel although amounts of from 10 to about 60 parts per million appear to be adequate for most applications. The weight ratio of the alkali metal or alkaline earth metal containing composition to the scavenger, if employed, is typically from about 5:1 to about 1:25, preferably about 3:1 to about 1:15.

The amount of the hydrocarbon-soluble ashless dispersant optionally included in the fuel compositions of this invention also can vary over a wide range, and the amount will depend in part on the amount of the metal-containing composition (A) to ashless dispersant can range from about 4:0.1 to about 1:4. The amount of the ashless dispersant to be included in the particular fuel composition can be determined readily by one skilled in the art and, obviously, the amount of dispersant contained in the fuel should not be so high as to have deleterious effects such as forming deposits on engine parts when the engine is cooled. Generally, fuels will be prepared to contain from about 50 to about 500 parts, and more preferably from about 80 to 400 parts by weight of the dispersant per million parts by weight of fuel.

The fuel compositions of the present invention can be prepared either by adding the individual components to a liquid hydrocarbon fuel, or a concentrate can be prepared comprising the components either neat or in a hydrocarbon diluent such as a mineral oil. Preferably, the diluent has a flash point in the range where the product facilitates combustion in the engine. When a concentrate is prepared, the relative amounts of the components included in the concentrate will correspond essentially to the relative amounts desired in the fuel composition. The products also give sufficient valve seat recession protection without an undue rise in the ORI.

The following examples illustrate the concentrates and fuel compositions in accordance with the present invention.

| | Parts by Weight |
|---|---|
| Example 1 (Concentrate) | |
| The neutral sodium salt of Example A-1 | 200 |
| The dispersant of Example B-1 | 75 |
| Mineral oil | 75 |
| Example 2 (Concentrate) | |
| The salt of Example A-3 | 100 |
| The dispersant of Example B-5 | 25 |
| Mineral oil | 25 |
| Example 3 (Concentrate) | |
| The neutral sodium salt of Example A-1 | 168 |
| The dispersant of Example B-2 | 42 |
| Heavy Oil | 40 |
| Mineral Oil | 200 |
| Example 4 (Concentrate) | |
| The salt of Example A-2 | 336 |
| The dispersant of Example B-2 | 84 |
| Heavy Oil | 80 |

Example 5

Unleaded gasoline is treated with the concentrate of Example 3 at a treatment level of about 400 lbs. per 1000 barrels of fuel.

Example 6

Unleaded gasoline is treated with the concentrate of Example 3 at a level of 200 pounds per thousand barrels of fuel.

Example 7

Unleaded gasoline is treated with the concentrate of Example 3 at a level of 250 pounds per thousand barrels of fuel.

Example 8

A tractor engine is stabilized using idolene clear fuel. After stabilization the fuel of Example 6 is introduced to the engine. The product performs satisfactorily to give valve seat protection.

Example 9

An engine having an initial octane requirement of 82 is fueled with indolene clear and run for 144 hours. The octane requirement at 144 hours increases five units due to stabilization of the engine. At the 144 hour mark the fuel is switched to indolene clear containing 250 PTB of the concentrate of Example 3. The engine is then run for a total of 264 hours and no increase in octane requirement is observed.

This example shows the effect of the additive on an engine designed to run on unleaded fuel. The valve protecting effect of the concentrate is also obtained.

In addition to the additives of this invention, the use of other conventional fuel additives is contemplated. Thus, the fuel compositions may also contain surface-ignition suppressants, demulsifiers, dyes, gum inhibitors, oxidation inhibitors, etc.

The present invention is directed generally to fuel compositions, but in particular to low-lead or unleaded gasoline compositions containing an alkali metal or alkaline earth metal composition, an ashless dispersant and a scavenger. While fuels containing the additives of the present invention preferably are low-lead or unleaded gasolines are burned in internal combustion engines, the fuel compositions of the present invention also are useful in lowering hydrocarbon emissions from the exhaust, producing improved combustion chamber and valve cleanliness, reducing varnish on pistons, reducing carburetor throat deposits and decreasing sludge and varnish in crankcase parts and valve covers.

What is claimed is:

1. A fuel composition comprising gasoline and at least one hydrocarbon-soluble or dispersible polybasic carboxylate salt of an alkali or alkaline earth metal and mixtures thereof.

2. The fuel composition of claim 1 wherein the polybasic carboxylate salt is the alkali metal salt.

3. The fuel composition of claim 1 wherein the hydrocarbon-soluble or dispersible polybasic carboxylate salt is a substituted succinate.

4. The fuel composition of claim 1 containing a hydrocarbon-soluble ashless dispersant.

5. The fuel composition of claim 2 wherein the salt is the sodium salt.

6. The fuel composition of claim 1 containing about 0.5 gram per liter or less of lead.

7. The fuel composition of claim 1 which is substantially free of phosphorus.

8. A fuel composition comprising gasoline and a hydrocarbon-soluble or dispersible polybasic carboxylate salt containing a hydrocarbyl residue wherein the molecular weight of the anionic portion of the salt is from about 400 to about 2000.

9. The fuel composition of claim 8 wherein the polybasic carboxylate salt is a substituted succinate.

10. The fuel composition of claim 8 wherein the hydrocarbyl residue of the polybasic carboxylate salt is from the group consisting of polybutylene, polypropylene, ethylene/proplylene polymers and mixtures thereof.

11. The fuel composition of claim 8 wherein the polybasic carboxylate salt is the alkali metal salt.

12. The fuel composition of claim 8 additionally containing a hydrocarbon-soluble ashless dispersant.

13. The fuel composition of claim 8 containing about 0.5 gram per liter or less of lead.

14. The fuel composition of claim 11 wherein the salt is the sodium salt.

15. The fuel composition of claim 12 wherein the dispersant is selected from the group consisting of (i) at least one hydrocarbyl-substituted amine wherein the hydrocarbyl substituent is substantially aliphatic and contains at least 8 carbon atoms;

(ii) at least one acylated, nitrogen-containing compound having a substituent of at least 10 aliphatic carbon atoms made by reacting a carboxylic acid acylating agent with at least one amino compound containing at least one

—NH— group, said acylating agent being linked to said amino compound through an imido, amido, amidine, or acyloxy ammonium linkage;

(iii) at least one nitrogen-containing condensate of a phenol, aldehyde and amino compound having at least one

—NH— group;

(iv) at least one ester of a substituted carboxylic acid;

(v) at least one polymeric dispersant;

(vi) at least one hydrocarbon substituted phenolic dispersant; and (vii) at least one fuel soluble alkoxylated derivative of an alcohol, phenol or amine.

16. The fuel composition of claim 15 wherein the amino compound is an alkylene polyamine of the general formula:

$$(R^3)_2N[-U-N(R^3)]_n-R^3$$

wherein U is an alkylene group of about 1 to about 18 carbon atoms, each $R^3$ is independently a hydrogen atom, an alkyl group or a hydroxy alkyl group containing up to about 30 carbon atoms, with the proviso than at least one $R^3$ is a hydrogen atom, and n is 1 to about 10.

17. The process of reducing valve seat recession in an engine without substantially increasing the octane requirement by introducing to the combustion chamber of the engine a product comprising:

(A) a polybasic carboxylate salt;

(B) a dispersant; and (C) gasoline the amount of the polybasic carboxylate salt being sufficient to reduce the valve seat recession.

18. The process of claim 17 wherein the polybasic carboxylate salt is a hydrocarbon substituted succinate wherein the cation is sodium and the anionic portion thereof has a molecular weight of about 400 to about 2000.

19. A concentrate for use in preparing a fuel comprising an alkali metal or alkaline earth metal polybasic carboxylate salt and a hydrocarbon-soluble ashless dispersant.

20. The concentrate of claim 19 additionally containing a hydrocarbon solvent or diluent.

21. The concentrate of claim 19 wherein the salt is the sodium salt.

* * * * *